United States Patent [19]

Brunty

[11] 4,179,828

[45] Dec. 25, 1979

[54] MULTI-PURPOSE LABOR SAVER HAND TOOL

[76] Inventor: Fred Brunty, Village Green-140, Princeton, W. Va. 24740

[21] Appl. No.: 895,732

[22] Filed: Apr. 13, 1978

[51] Int. Cl.[2] ..... E01H 5/02; A01D 7/10

[52] U.S. Cl. ..... 37/53; 37/124; 280/47.32; 15/106; 15/257.2; 56/400.04; 56/400.05

[58] Field of Search ..... 37/130, 131, 53; 298/3; 280/47.18, 47.2, 47.31, 47.3, 47.32, 47.33; 15/105, 106, 111, 159 R, 236 R, 257.2, 362; 56/400.01, 400.04, 400.05

[56] References Cited

U.S. PATENT DOCUMENTS

| | | | |
|---|---|---|---|
| 1,960,862 | 5/1934 | Baldwin | 280/47.31 X |
| 2,181,892 | 12/1939 | Head | 280/47.18 |
| 2,468,399 | 4/1949 | Grossman | 280/47.32 X |
| 2,502,138 | 3/1950 | Foreit | 280/47.18 |
| 2,840,142 | 6/1958 | Haug | 280/47.18 X |
| 3,248,128 | 4/1966 | Grable et al. | 280/47.31 |
| 3,258,275 | 6/1966 | Schaefer et al. | 280/47.2 |
| 3,350,797 | 11/1967 | Dassinger et al. | 37/53 |
| 3,375,019 | 3/1968 | O'Day | 280/47.32 |
| 3,643,356 | 2/1972 | Gohl | 37/53 |

FOREIGN PATENT DOCUMENTS

| | | | |
|---|---|---|---|
| 1157626 | 6/1958 | France | 280/47.32 |
| 1270532 | 4/1972 | United Kingdom | 280/47.32 |

*Primary Examiner*—E. H. Eickholt
*Attorney, Agent, or Firm*—John F. McClellan, Sr.

[57] ABSTRACT

A multi-purpose handle-directed, manually propelled wheeled vehicle particularly well adapted for safe snow removal, load carrying, and similar labor saving tasks in rough and uncertain terrain; in preferred embodiment a frame having open lenticular shape in plan view houses a wheel centrally between a "T" handle at the rear end and a load lug at the front end to which snow blade, heavy broomrake and other implements attach; at each end also on the upper surface a load pickup station is provided which supports a detachable bed or carrying body with drop-end and downwardly projecting legs providing, with the wheel, braked, non-tipping 3-point support when at rest.

4 Claims, 6 Drawing Figures

FIG. 2
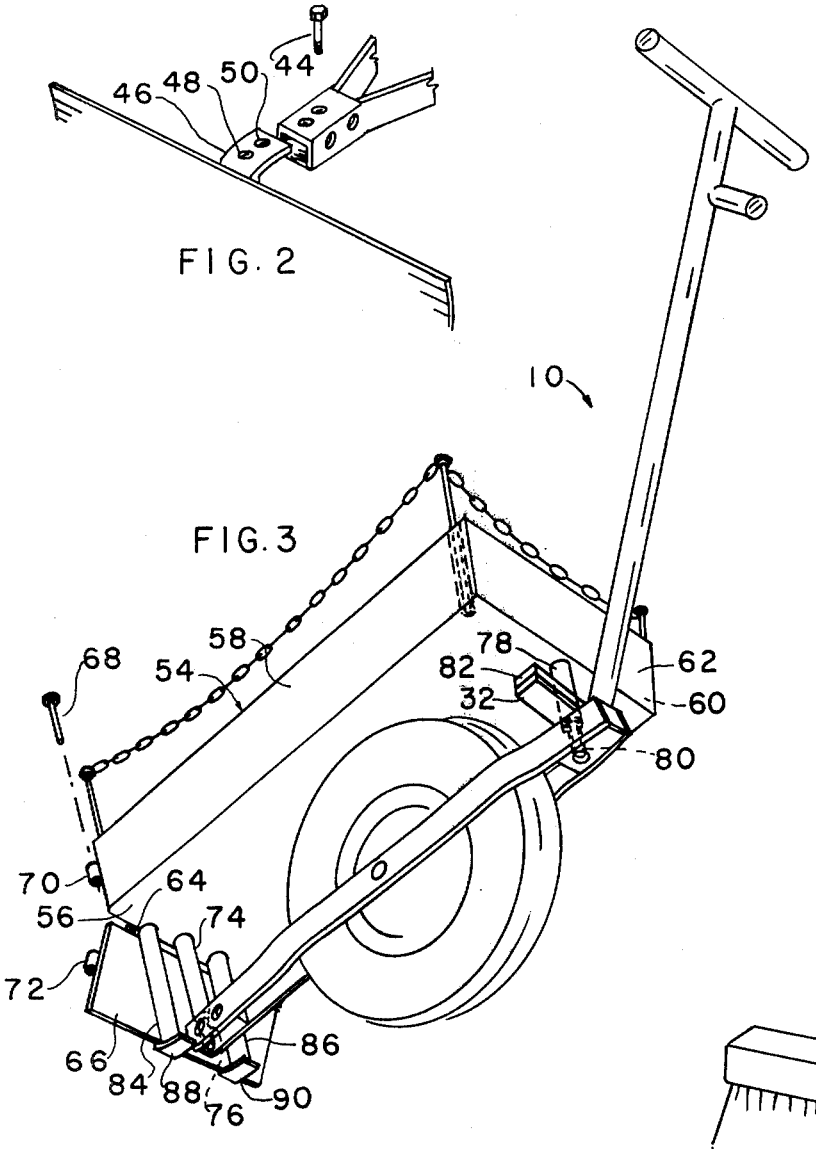
FIG. 3
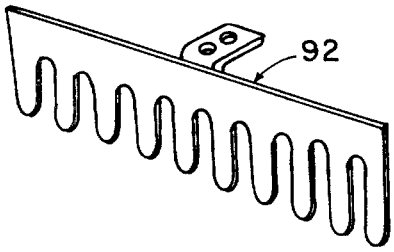
FIG. 4
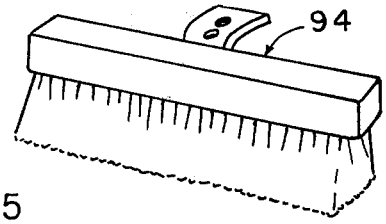
FIG. 5
FIG. 6
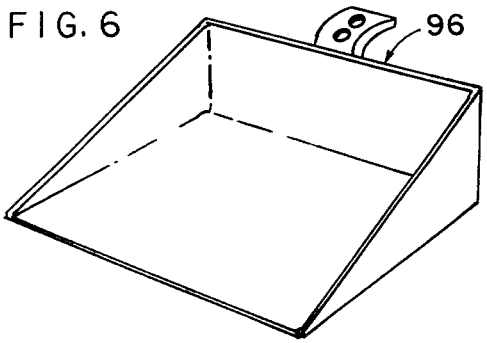

MULTI-PURPOSE LABOR SAVER HAND TOOL

This invention relates generally to land vehicles and particularly to handle-directed wheeled, utility vehicles.

In the prior art numerous utility vehicles of the class described have been disclosed, including for one category of tasks and users the vehicle described in my U.S. Pat. No. 4,048,735 issued Sept. 20, 1977 for MULTI-PURPOSE LABOR SAVER AND WHEELED TOOL. It is known to provide handle-equipped two-wheeled snow-removers, and brushes, two-wheeled carts, and exclusively two-wheeled vehicles of other utility designs. One-wheeled garden plows are known.

However, in accordance with the present invention, objects are to provide in the preferred embodiment a minimal-structure balanced-operation labor saving vehicle which safely tends to keep snow-plowing, load carrying and similar forces in alignment with the direction of motion, which provides the option of operator levelling or of automatic levelling of scraper or other front-end attachment; which provides low center of gravity with front-end accessories, which permits carrying of loads in level position regardless of sideways irregularities, which requires a very narrow track along which to roll, which can be steered by tipping and which provides handle-leverage for same, which provides a stable, non-teetering three-point platform for loading, which provides quick attachment and detachment of accessories or attachments and which stores substantially flat against a wall or the like when the accessories are detached.

The above and other objects and advantages of the invention will become more readily apparent on examination of the following description, including the drawings, in which the reference numerals refer to like parts:

FIG. 2 is an isometric detail showing hook-up for front-end attachments like the snowplow; and FIG. 3 is a perspective view of the invention showing load carrier attachment;

FIG. 4 is a perspective view of a rake attachment;

FIG. 5 is a perspective view of a sweep attachment; and

FIG. 6 is a perspective view of a scoop attachment.

Figure 1:
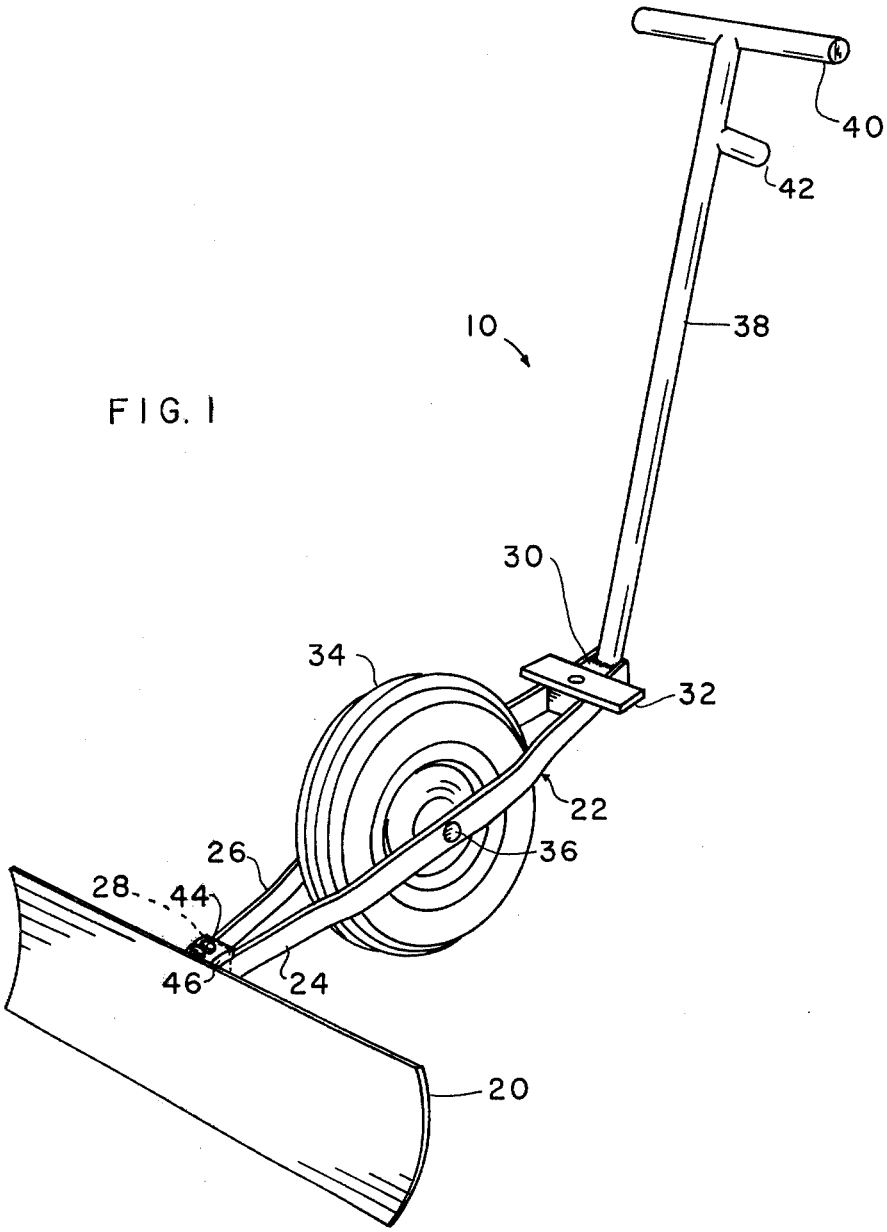
FIG. 1 is a perspective view of the invention with snowplow attached.

In FIG. 1 the novel frame assembly 10 of the invention is shown connected with a material working transverse attachment or snowplow attachment 20.

The frame assembly includes as components frame 22 comprising arc-shaped first and second side pieces 24,26, having welded junction in the front as a first lug 28 for load attachment and at the rear as a second lug 30 with welded perforate crosspiece 32 over it for foot-urging and for load attachment. A single wheel 34 is held in the space between the bowed side pieces on axle 36 which passes through the side pieces.

Handle 38 projects to the rear as a straight tube inclined at a 45° angle approximately from the second lug, to which it may be bolted or maybe welded, and terminates in a grip 40, "T" shaped at the handle end. A prop 42 projects downwardly from the handle near the upper end, preventing injury to the operator's hands by spacing the grip from the ground.

It will be seen that the frame assembly forms substantially the strongest and most rigid assembly practical for the weight and conventional materials used (strap iron, pipe, commercial wheel, bolt for axle) and if the handle is welded, with the fewest parts, actually only three: weldment, axle and wheel.

The snowplow attachment is also very simple; bolts 44 passing through holes not shown detachably secure to the first lug a flange 46 welded to and rearwardly projecting from the sheet steel blade top.

Because of the novel, thin aspect of the design, the frame assembly when detached can store substantially flat against a wall, to which it may be hung by the grip, or can store beneath a worktable, and can be easily loaded for carriage by a vehicle. For the same reason, large numbers can be shipped assembled, compactly fitted together, from manufacturer to dealers, the damage-resistant design minimizing need for packing materials. The thin lateral aspect also provides good visibility.

With a broad attachment such as snowplow, sweep, rake, or scoop, or the like, all of which can fasten in the same way being the same height, the one-wheel design permits manual three-axis-pivoting, maneuvering, pushing and pulling with surprisingly improved control over more conventional designs. The crosspiece at the rear lug provides for foot-thrusting and low lifting. And as a bonus, the design self-levels the blade, sweep, rake, or scoop, when desired, the attitude of the unit being established by the wheel as one point and by the ground-contacting extremes of the blade, broom or rake as the other two points, for operational three-point stability and ground-contour following. This and leverage of the upward angle of the handle make it unnecessary to provide the widely separated grips found in other one-wheel, operator powered devices such as wheelbarrows. Center of gravity is below the blade top.

Further, if desired, the snowplow, rake, sweep or scoop bolt-attachment can be loose, permitting a degree of independent pivoting further freeing the attachment for yielding, or can be attached at an angle for windrowing.

FIG. 2 shows the attachment mode described above, and usable with all similar transverse material working attachments, holes 48, 50 being provided for the bolts.

FIG. 3 shows the unit 10 with self-stabilizing bed or load carrier 54 having a bottom 56 supporting fixed sidewalls 58, 60, rear wall 62, and by a hinge 64, a pivotal-drop front wall 66 which can be held up by pins 68 in mating hinge halves 70, 72.

To support the load carrier above the wheel, cylindrical bracket 74 extends down from the bed to pin-in-hole attachment 76 at the front lug, the necked-down lower part of the bracket fitting into a hole in the lug. Rear leg 78 extends down to supportive pin-in-hole engagement 80 through the crosspiece at the rear lug. On the rear leg a fixed cross member 82 opposes the crosspiece 32 on the rear lug for stability there; when pressed with the foot in urging the vehicle it tends to keep the load carrier attachment secure. Attachment 76 can be made through either of the holes 48, 50, FIG. 2, with a transverse attachment in place, permitting use of the load carrier with any transverse attachment.

A further novel feature is apparent in that the load carrier has outboard the bracket at the front a pair of lateral legs 84, 86, each with a front-upturned skid 88, 90 on the end. The legs may terminate low relative to the frame in position to serve as two resting points supplementing the wheel as the third resting point, when the unit is tipped forward for load resting. These features also permit easy assembly and disassembly of the load carrier, with or without load. When off the frame the load carrier is supported at three points for stability. On soft ground the broad elements 88, 90 and 82 tend to limit sinking.

FIG. 4 shows a rake attachment 92 which detachably affixes like the snow plow.

FIG. 5 shows a similar sweep attachment 94. For heavy self-levelling scraping, raking or sweeping the operators can simply raise the handle, adding the weight of the handle, wheel and frame parts to the implement while drawing the unit backward and/or thrusting it forward. Even with the wheel on the ground, the rake and sweeper also self-level so that nothing is missed and a uniform work appearnace results.

FIG. 6 shows a scoop 96 attachable like the other implements with one bolt and also self-levelling in operation so that the load is scooped up uniformly from one side to the other. Because of the upward angle of the handle, the harder the push against load resistance, the greater the self-levelling forces at the implement in all embodiments.

The load carrier is an important co-acting element in combination with any of the transversely extending, relatively symmetrical attachments ahead of the single wheel. Material dumped from the body onto the scoop can be lightly spread, and as the body overhangs the transverse member location, material dumped can be spread by any of the transverse members in a continuing operation.

When passing along a side slope falling away to the right, for example, the left side of the load carrier can be conveniently weighed by sand or gravel to trim the action, and at turnaround, the load can be relocated to the other side by tipping beyond the operating attitude. Similarly load trim in the load carrier can be employed to increase force on the front end implement or to decrease force on it. On most ground contours encountered the transverse attachments can be used to stabilize the load carrier when heavily loaded and standing or being drawn.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a vehicle having a handle for manual propulsion, a frame attached to the handle, and wheel support for the frame, the improvement comprising: the frame including a left and a right side piece in laterally spaced relation, the wheel support comprising a single wheel, an axle mounting the single wheel between the left and right side pieces, the handle projecting at an upward angle rearwardly from the frame, a transverse attachment for material working, means detachably affixing a middle portion of the transverse attachment to the frame forward of the wheel, a load carrier over the wheel, first means detachably connecting the load carrier with the frame forward of the wheel, second means detachably connecting the load carrier with the frame rearward of the wheel, the load carrier having a body, a pair of forward legs projecting downwardly from the body respectively laterally of the first means, the downward projection of said pair of forward legs being below the frame for serving as supports in conjunction with the wheel, and the second means comprising a pin-in-hole attachment and having adjacent the lower end thereof a fixed cross member for pushing and for limiting sinking in soft ground when the load carrier is resting on the ground.

2. In a vehicle having a handle for manual propulsion, a frame attached to the handle, and wheel support for the frame, the improvement comprising: the frame including a left and a right side piece in laterally spaced relation, the wheel support comprising a single wheel, an axle mounting the single wheel between the left and right side pieces, the handle projecting at an upward angle rearwardly from the frame, a transverse attachment for material working, means detachably affixing a middle portion of the transverse attachment to the frame forward of the wheel, a load carrier over the wheel, the frame having a perforate crosspiece fixed thereacross rearwardly of the wheel in position for use in foot-urging the vehicle forwardly, and the second means having a pin proportioned for passing into the perforation and securing the rearward end of the load carrier.

3. In a vehicle as recited in claim 2, the side pieces bowed away from each other around the wheel and being closer to each other forward of the wheel and rearward of the wheel than where bowed outwardly.

4. In a vehicle as recited in claim 3, the handle upward angle being substantially 45°.

* * * * *